United States Patent [19]

Piotrowski et al.

[11] 4,440,658

[45] Apr. 3, 1984

[54] ANTI-RUST COMPOSITIONS

[75] Inventors: Alfred B. Piotrowski; Richard S. Herd, both of Woodbury, N.J.

[73] Assignee: Mobil Oil Corporation, New York, N.Y.

[21] Appl. No.: 225,574

[22] Filed: Jan. 16, 1981

[51] Int. Cl.[3] ..... C10M 1/32

[52] U.S. Cl. ..... 252/51.5 A; 252/51.5 R

[58] Field of Search ..... 252/51.5 A, 51.5 R

[56] References Cited

U.S. PATENT DOCUMENTS

| | | | |
|---|---|---|---|
| 3,219,666 | 11/1965 | Norman et al. | 252/51.5 A |
| 3,272,746 | 9/1966 | Le Suer et al. | 252/51.5 A |
| 3,415,750 | 12/1968 | Anzenberger | 252/51.5 A |

*Primary Examiner*—Jacqueline V. Howard

*Attorney, Agent, or Firm*—Alexander J. McKillop; Michael G. Gilman; Howard M. Flournoy

[57] ABSTRACT

Certain partial esters of phthalic acid provide effective rust inhibition for greases and other solid lubricants.

7 Claims, No Drawings

ANTI-RUST COMPOSITIONS

BACKGROUND OF THE INVENTION

1. Field of the Invention

This application is directed to rust inhibitors and to anti-rust compositions containing same.

2. Discussion of the Prior Art

The prior art has, heretofore, provided grease formulations containing a variety of improvement additives. When the greases must undergo widely varying temperature changes during the course of operating conditions, moisture will condensate and rust or corrode metal parts in contact with the grease. Greases are accordingly expected to show a high degree of resistance to water. Therefore, there is a continual need for additives which will improve the anti-rust characteristics of grease formulations. Anti-rust grease compositions as disclosed herein comprising a major proportion of an oil of lubricating viscosity, an effective amount of a suitable thickening agent and a minor effective amount of the additive compounds disclosed herein, as for example a mono-alkylimidazolyl-ethyl phthalate or a t-alkyl primary amine salt thereof have not, to the best of applicants' knowledge and belief, been previously disclosed.

SUMMARY OF THE INVENTION

This invention is directed to certain partial esters and amides of phthalic acid and t-alkyl amine salts thereof which are useful in solid lubricants such as greases, for inhibiting the formation of rust. This invention is accordingly also directed to solid lubricant formulations, e.g., greases containing minor effective amounts of said esters of phthalic acid, as for example mono-2-naphthenyl-2-imidazolyl-1-ethyl phthalate, to inhibit rusting of metal surfaces contacting said lubricants.

DESCRIPTION OF SPECIFIC EMBODIMENTS

The present invention is more particularly directed to mono-alkylimidazolyl-ethyl phthalates and to t-alkyl primary amine salts thereof and lubricant compositions containing same. The alkyl group therein may contain from about 1 to about 30 carbon atoms. Preferred alkyl groups include ethyl, butyl and nonyl and/or alkyl groups resulting from preparing the phthalates and their amine salts from napthenic acids or decanoic acids. For example, if a decanoic acid is used, the resulting phthalate will have a $C_9$ alkyl group rather than a $C_{10}$ group.

The above-described additive compounds may be prepared by reacting one mole of hydroxyethyl-ethylene diamine with an appropriate organic acid, e.g., naphthenic or decanoic and then reacting the intermediate hydroxyethyl alkylimidazoline with phthalic anhydride. The t-alkyl amine salts of the alkylimidazoyl ethyl phthalates may thereafter be prepared in any convenient manner known to the art.

The novel greases of the present invention may be prepared in accordance with conventional grease manufacturing procedures, or by any mixing technique in which solid particles are wetted by a fluid. In general, mineral oils when employed as the lubricant or grease vehicle, may be of any suitable lubricating viscosity range, as for example, from about 45 SSU at 100° F. to about 6000 SSU at 100° F. and preferably from about 50 SSU at 210° F. to about 250 SSU at 210° F. These oils may have viscosity indices varying from below 0 to about 100 or higher. The average molecular weights of these oils may range from about 250 to about 800. The lubricating oil is generally employed in an amount sufficient to balance the total grease composition after accounting for the desired quantity of the thickening agent and other additive components to be included in the grease formulation. In instances where synthetic oils are desired in preference to mineral oils as the vehicle for the grease, or in combinations with mineral oils, a variety of synthetic oils can be used. Typical synthetic vehicles include polyisobutylene, polybutylenes, hydrogenated polydecenes, polypropylene glycol, polyethylene glycol, trimethylol propane esters, neopentyl and pentaerythritol esters, di(2-ethylhexyl)sebacate, di(2-ethylhexyl)adipate, dibutyl phthalate, fluorocarbons, silicate esters, silanes esters of phosphorous-containing acids, liquid ureas, ferrocene derivatives, hydrogenated mineral oils, chain-type polyphenyls, siloxanes and silicones (polysiloxanes), alkylsubstituted diphenyl ethers typified by a butyl-substituted bis(p-phenoxy phenyl)ether, phenoxy phenylethers, etc.

With respect to imparting improved anti-rust properties to greases, which contain the above-described additives, any thickening agent normally employed in grease formulations may be successfully utilized. Particularly preferred are greases which contain such conventional thickening agents as lithium hydroxystearate, lithium complexes, calcium complexes, clay-based thickening agents, polyurea based thickening agents and a wide variety of other metallic soaps and thickeners normally employed in the grease-making art. Most especially preferred are lithium soap greases. In addition, other additives, normally employed for imparting anti-rust properties may also be incorporated into the novel greases.

It is to be understood also that the compositions contemplated herein can contain other additive materials. For example, antioxidants, corrosion inhibitors, extreme pressure agents, viscosity index agents, and fillers can be used. Among such materials are colloidal silica, calcium acetate, calcium carbonate and molybdenum disulfide. Such additives or characterizing materials do not detract from the lubricating value of the compositions of this invention, nor do they detract from the beneficial character of the imidazolyl phthalates or their t-alkyl amine salts; rather, these materials serve to impart their customary properties to the particular compositions into which they are incorporated.

The additive anti-rust compounds embodied herein are employed in a minor amount sufficient to incorporate into the grease formulation the desired degree of effective resistance or inhibition to rust formation. Particularly preferred are greases in which the additive is present in an amount of at least about 0.01% to about 10% by weight, based on the weight of the total composition. For most purposes amounts from about 0.1 to about 5%, by weight produce highly satisfactory improved grease compositions.

Having described the invention in general terms the following examples are specific embodiments thereof which, however, are intended not to limit the scope of this specification or the claims.

EXAMPLE 1

Mono-2-naphthenyl-2-imidazolyl-1-ethyl phthalate 1-mole of naphthenic acid obtained commercially was reacted with 1-mole of 2-(2-aminoethylamino)ethanol in 100 cc. of toluene. During the reaction period, solvent and water were continuously taken off until the theoretical amount of water (2 moles) was taken off to a temperature of 183° C. The solvent was then stripped off under vacuum and the resulting residue or product filtered through Hi-flow and recovered.

One mole of phthalic anhydride was reacted with one mole of 1-hydroxyethyl-2-naphthenyl-2-imidazoline prepared as above in 200 cc. of toluene at 135° C. for 3–4 hours. To maintain the temperature at 135° C. solvent was periodically taken off. After the requisite reaction time, the toluene was stripped off under vacuum and the residue (product) bottled.

EXAMPLE 2

Mono-2-nonyl-2-imidazolyl-1-ethyl phthalate

One mole of n-decanoic acid was reacted with one mole of 2-(2-aminoethylamino)ethanol in 100 cc. of toluene. During the reaction period, solvent and water were continuously taken off until the theoretical amount of water (2 moles) was taken off to a temperature of 183° C. The solvent was then stripped off under vacuum and the residue (product) was filtered through Hi-flow and recovered.

One mole of phthalic anhydride was reacted with 1-mole of 1-hydroxyethyl-2-nonyl-2-imidazoline prepared as above in 200 cc. of toluene at 135° C. for 3–4 hours. Solvent was periodically taken off to maintain the temperature at 130° C. After the requisite reaction time, the toluene was stripped off under vacuum and the residue (product) bottled.

EXAMPLE 3

One mole of the mono-2-nonyl-2-imidazolyl-1-ethyl phthalate (from Example 2 above) was reacted with one mole of a $C_{12}$–$C_{14}$ t-alkyl primary amine (Neutralization Equivalent = 191) for 30 minutes at 90° C. Thereafter, the reaction product was recovered, evaluated, and bottled.

EXAMPLE 4

One mole of 1-hydroxyethyl-2-naphthenyl-2-imidazoline was reacted with 1-mole of phthalic anhydride at 135° C. for 3–4 hours. The resulting 2-naphthenyl mono-2-naphthenyl-2-imidazolyl-1-ethyl phthalate was recovered, evaluated and bottled.

The 1-hydroxyethyl-2-naphthenyl-2-imidazoline was prepared by reaction of 1-mole of naphthenic acid (m. wt. = 366) which was obtained commercially with 1-mole of 2-(2-aminoethylamino)ethanol in 100 cc of toluene. During the reaction period, solvent and water were continuously taken off until the theoretical amount of water (2-moles) was taken off up to a temperature of 187° C. The solvent was then stripped off under vacuum and the residue or product filtered through HI-FLOW and recovered. This product was then reacted with phthalic anhydride to obtain the mono-2-naphthenyl-2-imidazolyl-1-ethyl phthalate described.

EXAMPLE 5

One mole of the mono-2-naphthenyl-2-imidazolyl-1-ethyl phthalate (from Example 4) was reacted with 1-mole of a $C_{12}$–$C_{14}$ t-alkyl primary amine (Neut. Eq. = 191) for 30 minutes at 90° C. The reaction product was then recovered, evaluated and bottled.

EXAMPLE 6

One mole of the mono-amide, obtained from the reaction of 1-mole of phthalic anhydride with 1-mole of morpholine at 135° C. for 3–4 hours, was reacted with 1-mole of $C_{12}$–$C_{14}$ t-alkyl primary amine (Neut. Eq. = 191) for 30 minutes at 90° C. The reaction product was recovered, evaluated and bottled.

EXAMPLE 7

One mole of 1-hydroxyethyl-2-naphthenyl-2-imidazoline (see prep paragraph below) was reacted with 1-mole of phthalic anhydride at 135° C. for 3–4 hours. The resulting mono-2-naphthenyl-2-imidazolyl-1-ethyl phthalate was recovered, evaluated and bottled.

The 1-hydroxyethyl-2-naphthenyl-2-imidazoline was prepared by reaction of 1-mole of naphthenic acid (m. wt. = 460.2), which was obtained commercially with 1-mole of 2-(2-aminoethylamino)ethanol in 100 cc of toluene. During the reaction period, solvent and water were continuously taken off until the theoretical amount of water (2-moles) was taken off up to a temperature of 187° C. The solvent was then stripped off under vacuum and the residue or product filtered through Hi-flow and recovered. The resulting product was then reacted with phthalic anhydride to obtain the mono-2-naphthenyl-2-imidazolyl-1-ethyl phthalate described above.

EXAMPLE 8

One mole of the mono-2-naphthenyl-2-imidazolyl-1-ethyl phthalate (from Example 7) was reacted with 1-mole of a $C_{12}$–$C_{14}$ t-alkyl primary amine (Neut. Eq. = 191) for 30 minutes at 90° C. The reaction product was thereafter recovered, evaluated and bottled.

EXAMPLE 9

One mole of 1-hydroxyethyl-2-naphthenyl-2-imidazoline (see prep paragraph below) was reacted with 1-mole of phthalic anhydride at 135° C. for 3–4 hours. The resulting mono-2-naphthenyl-2-imidazolyl-1-ethyl phthalate was thereafter recovered, evaluated and bottled.

The 1-hydroxyethyl-2-naphthenyl-2-imidazoline was prepared by reaction of 1-mole of naphthenic acid (m. wt. = 256.4), which was obtained commercially, with 1-mole of 2-(2-aminoethylamino)ethanol in 100 cc of toluene. During this reaction period, solvent and water were continuously taken off until the theoretical amount of water (2-moles) was taken off up to a temperature of 187°–190° C. The solvent was then stripped off under vacuum and the residue or product filtered through Hi-flow and recovered. This product was then reacted with phthallic anhydride to obtain the mono-2-naphthenyl-2-imidazolyl-1-ethyl phthalate mentioned herein above.

EXAMPLE 10

One mole of the mono-2-naphthenyl-2-imidazolyl-1-ethyl phthalate (from Example 9) was reacted with 1-mole of a $C_{12}$–$C_{14}$ t-alkyl primary amine (Neut. Eq. = 191) for 30 minutes at 90° C. The reaction product was thereafter bottled and evaluated.

EXAMPLE 11

One mole of the mono-amide, obtained from the reaction of 1-mole of phthalic anhydride with 1-mole of tetrahydropyrrole at 135° C. for 3–4 hours, was reacted with 1-mole of a $C_{12}$–$C_{14}$ t-alkyl primary amine (Neut. Eq. = 191) for 30 minutes at 90° C. The resulting reaction product was then bottled and evaluated.

EXAMPLE 12

One mole of the mono-amide, obtained from the reaction of 1-mole of maleic anhydride with 1-mole of di-2-ethylhexylamine at 135° C. for 3–4 hours, was reacted with 1-mole of a $C_{12}$–$C_{14}$ t-alkyl primary amine (Neut. Eq. = 191) for 30 minute at 90° C. The reaction product thereof was then recovered, bottled and evaluated.

EXAMPLE 13

One mole of the mono-cyclohexylmethyl tetrahydrophthalate, obtained from the reaction of 1-mole of cis-1,2,3,6-tetrahydrophthalic anhydride with one mole of cyclohexylmethanol at 135° C. for 3–4 hours, was reacted with 1-mole of a $C_{12}$–$C_{14}$ t-alkyl primary amine (Neut. Eq. = 191) for 30 minutes at 90° C. The reaction product was then bottled and evaluated.

EXAMPLE 14

One mole of the mono-cyclohexylmethyl succinate, obtained from the reaction of one mole of cyclohexylmethanol with 1-mole succinic anhydride at 135° C. for 3–4 hours, was reacted with 1-mole of a $C_{12}$–$C_{14}$ t-alkyl primary amine (Neut. Eq. = 191) for 30 minutes at 90° C. The product was then bottled and evaluated after being recovered.

EXAMPLE 15

One mole of the mono-cyclohexylmethyl glutarate, obtained from the reaction of 1-mole of cyclohexylmethanol with 1-mole of glutaric anhydride at 135° C. for 3–4 hours, was reacted with 1-mole of a $C_{12}$–$C_{14}$ t-alkyl primary amine (Neut. Eq. = 191) for 30 minutes at 90° C. The product was then bottled and evaluated after being recovered.

All of the above reactants, unless specified to the contrary, were obtained commercially or prepared by standard conventional methods.

The above prepared examples were then subjected to a well known corrosion test (ASTM D1743-73) to determine their rust inhibiting effectiveness. Test results are given in the Table below. The standard test method was modified by using 5% or 100% synthetic sea water, and by storing after exposure to the water for 24 or 48 hours as well as using only 2 bearings.

The rating procedure is as follows: a bearing showing no corrosion is rated 1. Incipient corrosion, no more than 2 spots of a size just sufficient to be visible to the naked eye is rated 2. Larger or more spots are rated 3 and fail the test.

RESULTS RUST TEST

| | Formulation | Conc. | 100% Sea Water Rating | 100% Sea Water % Corr. | 5% Sea Water (24 hours) Rating | 5% Sea Water (24 hours) % Corr.* |
|---|---|---|---|---|---|---|
| 1. | Base Grease | 100 | 3 | 80 | 3 | 5 |
| | | 100 | 3 | 90 | 3 | 15 |
| 2. | Base Grease + | 95 | 3 | 15 | 1 | 0 |
| | Example No. 1 | 5 | 3 | 10 | 2 | |
| 3. | Base Grease + | 95 | 3 | 15 | 1 | 0 |
| | Example No. 2 | 5 | 1 | 0 | 1 | 0 |
| 4. | Base Grease | 95 | | | 1 | 0 |
| | Example No. 2 | 5 | | | 2+ | 0 |
| 5. | Base Grease | 95 | | | 1 | 0 |
| | Example No. 3 | 5 | | | 1 | 0 |
| 6. | Base Grease | 95 | | | 1 | 0 |
| | Example No. 4 | 5 | | | 2+ | * |

-continued

RESULTS RUST TEST

| | Formulation | Conc. | 100% Sea Water Rating | 100% Sea Water % Corr. | 5% Sea Water (24 hours) Rating | 5% Sea Water (24 hours) % Corr.* |
|---|---|---|---|---|---|---|
| 7. | Base Grease | 95 | | | 1 | 0 |
| | Example No. 5 | 5 | | | 1 | 0 |
| 8. | Base Grease | 95 | | | 2 | * |
| | Example No. 6 | 5 | | | 2 | * |
| 9. | Base Grease | 95 | | | 3 | 5 |
| | Naphthenic Acid | 5 | | | 3 | 10 |
| 10. | Base Grease | 95 | | | 3 | 2 |
| | Example No. 7 | 5 | | | 3 | 5 |
| 11. | Base Grease | 95 | | | 1 | 0 |
| | Example No. 8 | 5 | | | 3 | 1 |
| 12. | Base Grease | 95 | | | 2 | 0 |
| | Example No. 9 | 5 | | | 2+ | 1 |
| 13. | Base Grease | 95 | | | 1 | 0 |
| | Example No. 10 | 5 | | | 1 | 0 |
| 14. | Base Grease | 95 | | | 2 | — |
| | Example No. 11 | 5 | | | 2+ | — |
| 15. | Base Grease | 95 | | | 1 | 0 |
| | Example No. 12 | 5 | | | 1 | 0 |
| 16. | Base Grease | 95 | | | 2 | — |
| | Example No. 13 | 5 | | | 2+ | — |
| 17. | Base Grease | 95 | | | 2 | — |
| | Example No. 14 | 5 | | | 2+ | — |
| 18. | Base Grease | 95 | | | 2 | — |
| | Example No. 15 | 5 | | | 2+ | — |

*Footnotes:
Rating
#1 = Pass - No Corrosion
#2 = Max-Allow - 2 Spots
#3 = Fail
Base Grease: Conventional formulated luthium mineral oil base soap grease containing standard additives such as E.P. agent, antioxidant, metal passivator water, etc., wherein the anti-rust agent has been removed.

The data of the Table clearly show the improved anti-rust characteristics of grease formulations in accordance with the present invention. It is noted that a related compound and the base grease tested in identical manner showed significantly less effectiveness than the additive compounds of the present invention.

It is understood that departures and variations from the exemplary material disclosed herein can be readily made and are within the scope of the specification and the claims appended hereto.

We claim:

1. A lubricant comprising a major amount of a grease or other solid lubricant prepared from an oil of lubricating viscosity and a minor amount, of an anti-rust additive compound sufficient to inhibit rust formation on metal surfaces contacting said grease, of a t-alkyl primary amine salt of a mono-alkylimidazolylethyl phthalate or mixtures thereof wherein said alkyl group contains from about 1 to about 30 carbon atoms and wherein a first compound is prepared by reacting equi-molar amounts of phthalic anhydride and an imidazoline, and thereafter reacting equi-molar amounts of said first compound and a t-alkyl primary amine.

2. The composition of claim 1 wherein the additive compound is the reaction product of molar amounts of mono-2-imidazolyl-1-ethyl phthalate and a $C_{12}$–$C_{14}$ tertiary-alkyl primary amine.

3. The composition of claim 1 wherein said grease is a lithium base soap grease.

4. The composition of claim 1 containing from about 0.01 to 10 wt. % of said additive.

5. The composition of claim 1 containing from about 0.1 to 5 wt. % of said additve.

6. The composition of claims 3 containing in addition to said anti-rust additive other known, conventional anti-rust additive materials.

7. The composition of claim 6 containing in addition to said anti-rust materials other conventional additive material suitable for their known purposes.

* * * * *